US007324653B2

(12) United States Patent
Mehr

(10) Patent No.: US 7,324,653 B2
(45) Date of Patent: Jan. 29, 2008

(54) SUSPENSION MEANS FOR TRANSDUCER

(75) Inventor: Ulrik Mehr, Hellerup (DK)

(73) Assignee: Oticon A/S, Smørum (DK)

( * ) Notice: Subject to any disclaimer, the term of this patent is extended or adjusted under 35 U.S.C. 154(b) by 95 days.

(21) Appl. No.: 10/517,202

(22) PCT Filed: Jun. 16, 2003

(86) PCT No.: PCT/DK03/00399

§ 371 (c)(1),
(2), (4) Date: Jan. 10, 2005

(87) PCT Pub. No.: WO2004/008803

PCT Pub. Date: Jan. 22, 2004

(65) Prior Publication Data

US 2006/0153411 A1 Jul. 13, 2006

(30) Foreign Application Priority Data

Jul. 12, 2002 (DK) ..... 2002 01102

(51) Int. Cl.
*H04R 25/00* (2006.01)

(52) U.S. Cl. ..... 381/324; 381/328; 381/330

(58) Field of Classification Search ..... 381/338, 381/368, 366, 365, 361, 355, 341, 340, 337, 381/339, 91, 332, 71.5, 324, 345, 330, 328, 381/325, 322; 181/196, 22, 192, 193, 130, 181/135, 137

See application file for complete search history.

(56) References Cited

U.S. PATENT DOCUMENTS 3,368,644 A * 2/1968 Henderson ..... 181/129
4,440,982 A 4/1984 Kaanders et al.
4,564,955 A * 1/1986 Birch et al. ..... 381/330
4,620,605 A 11/1986 Gore et al.
4,712,642 A * 12/1987 Lalikos et al. ..... 181/207
4,729,451 A 3/1988 Brander et al.
4,972,488 A * 11/1990 Weiss et al. ..... 381/325
5,278,360 A * 1/1994 Carbe et al. ..... 181/135
5,864,628 A 1/1999 Posen et al.
5,890,072 A * 3/1999 Rabe ..... 455/550.1
5,975,235 A * 11/1999 Schlaegel et al. ..... 181/129
6,771,787 B1 * 8/2004 Hoefler et al. ..... 381/338

FOREIGN PATENT DOCUMENTS

JP 01171398 A * 7/1989
WO 0072632 11/2000
WO 0143498 6/2001

* cited by examiner

*Primary Examiner*—Sinh Tran
*Assistant Examiner*—Joseph Saunders, Jr.
(74) *Attorney, Agent, or Firm*—Dykema Gossett PLLC

(57) ABSTRACT

A suspension tube for a transducer, wherein the suspension tube also functions as a sound-guide for directing sound between the transducer and the external cabinet of an audio processing device, wherein the suspension tube has means for forming a connection with the inlet/outlet of the transducer at a first end and means for forming a connection with the cabinet wall of the audio processing device at a second end in order to guide sound through the tube, and wherein the intermediate part of the tube in the length direction has alternating wide and narrow parts.

2 Claims, 3 Drawing Sheets

SUSPENSION MEANS FOR TRANSDUCER

AREA OF THE INVENTION

Suspension means for transducers are used in various acoustic equipment, and especially in hearing aids the play an important role in the overall performance of the apparatus. One of the issues, which in hearing aids are influenced by the performance of the suspensions is damping of vibrations transmitted from the casing material through the suspension to the transducer. Also the receiver will vibrate at normal operation and sound and vibration is radiated into the casing. This sound and vibration must be prevented from reaching the microphone.

BACKGROUND OF THE INVENTION

In an attempt to solve the above problem the transducers of hearing aids are isolated from the casing or shell of the hearing aid by flexible suspension means. Also the canal bringing audio signals to/from the transducers is made of a resilient material in order to counteract the transmission of vibrations from the casing to the transducer. The invention seeks to improve the canals ability to transport the sound signals to/from the transducers without transmitting vibrations through the canal walls.

SUMMARY OF THE INVENTION

This is achieved by a suspension means for a transducer, where the suspension means also functions as a sound-guide for directing sound between the transducer and the external cabinet of an audio processing device, where the suspension is shaped as a tube which has means for forming a connection with the inlet/outlet of the transducer at a first end and means for forming a connection with the cabinet wall of the audio processing device at a second end in order to guide sound through the tube, where the intermediate part of the tube in the length direction has alternating wide and narrow parts.

The alternation between narrow and wide parts of the tube aids to dampen vibrations transmitted inside the wall material of the tube, and this help to isolate the transducer from the cabinet/shell part of the hearing aid. The reduction of the transmission of vibrations is in part due to the longer path, which the vibrations has to travel through the material of the tube, due to the wide and narrow parts of the tube. This allows the use of a more stiff material without sacrificing the damping effect from shell to transducer.

In an embodiment the wide and narrow parts are shaped as circumferentially extending bellows. This shape is very easy to produce in injection molding technique. The bellows could be circular or follow a thread like path along the length of the tube like structure.

In another embodiment the circumference of the tube like structure is oval shaped. This helps to provide an opening with a wide cross section.

In a further embodiment where at least two consecutive sections each comprising a wide and a narrow part, the consecutive sections are shaped to have unlike resonance frequencies. This is an advantage because at the resonance frequency of one section the consecutive section will dampen vibrations/sounds and vice versa. The sections can be made with unlike resonant frequencies in a number of different ways: consecutive sections may have different sizes of the wide and/or narrow parts, they may be shaped with different thickness of the walls, diverse material may be uses for consecutive sections creating differences in resilience and/or density of the sections. Also combinations of these possibilities is an option.

DESCRIPTION OF A PREFERRED EMBODIMENT

Figure 1:
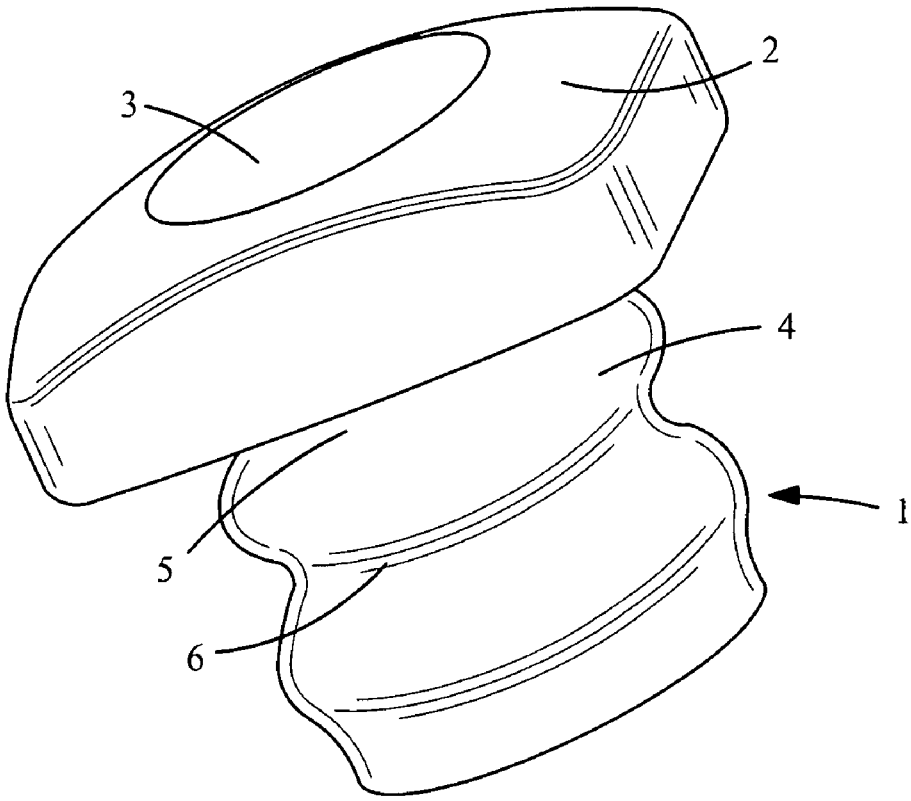
FIG. 1 shows a suspension for a hearing aid receiver.

The suspension in FIG. 1 is a receiver suspension, and it has an opening 3, which is supposed to receive a sound conveying pipe which guides the sound toward the ear. An outwardly directed flange 2 surrounds the opening 3 and may be held in place by suitable fastening means within the shell of the hearing aid. At the other end the suspension is shaped to fit snuggly around the snout part of a hearing aid receiver (not shown). Between the flange part 2 and the receiver end the suspension 1 is shaped as a pipe like structure which has alternating wide and narrow parts. A wide part 4 is shown in the middle between two narrow parts 5,6.

Figure 2:
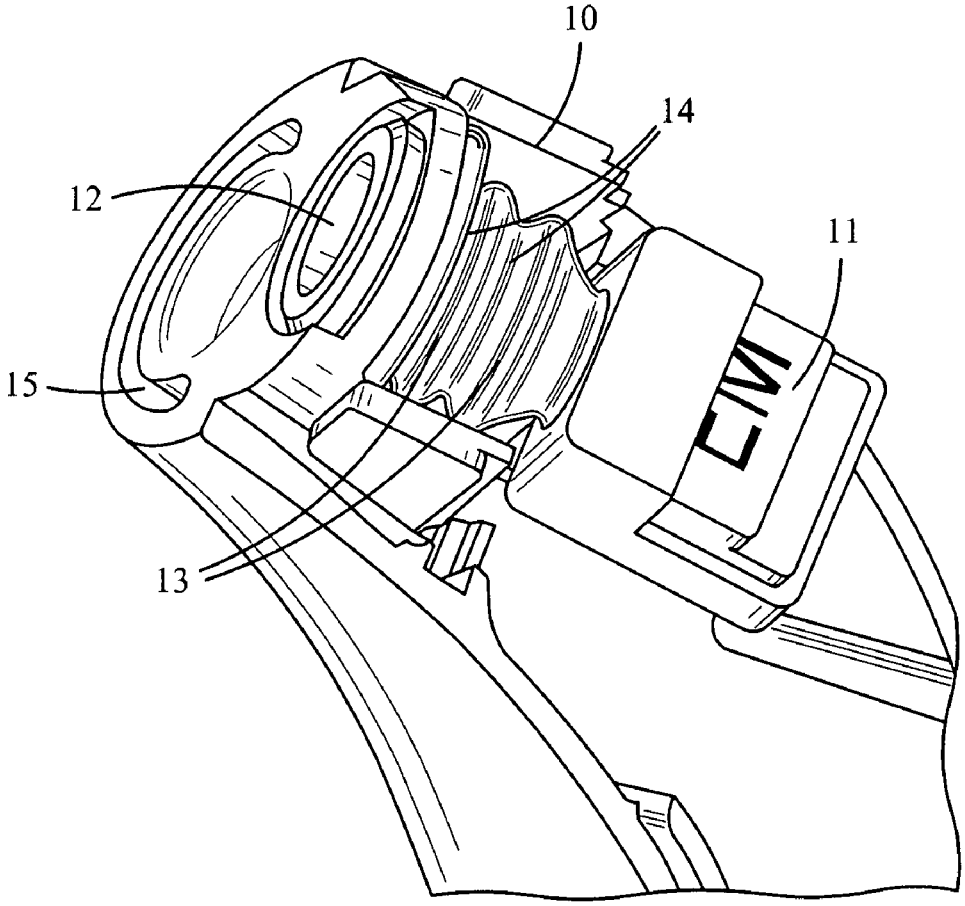
FIG. 2 shows a part of a hearing aid with the shell partially removed so that the suspension for the microphone is visible.

In FIG. 2 a suspension 10 for a microphone 11 is shown. The suspension 10 comprises a tube like structure with an inlet 12 at one end thereof and a microphone 11 coupled to the other end thereof. The inlet 12 is coupled to the cabinet 15 of the hearing aid at the surface thereof, and sound impinging on the hearing aid from the surroundings enters the inlet 12 and propagates inside the tube towards the microphone 11. Between the microphone 11 and the inlet 12 the tube is shaped with consecutive wide and narrow part 13, 14. The wide and narrow parts prevent vibrations from propagating along the length of the tube within the tubing material. Thereby the microphone becomes more effectively isolated from the shell or cabinet 15 of the hearing aid. This is very important as only sounds generated in the environment are intended to reach the microphone 11, whereas sounds from within the hearing aid and vibrations propagating along the cabinet structure are considered as noise and should be damped as far as possible.

In the shown embodiment the tube is also oval in cross section. This has the effect that an opening with a wider area is achieved while the height of the apparatus is kept low.

Figure 3:
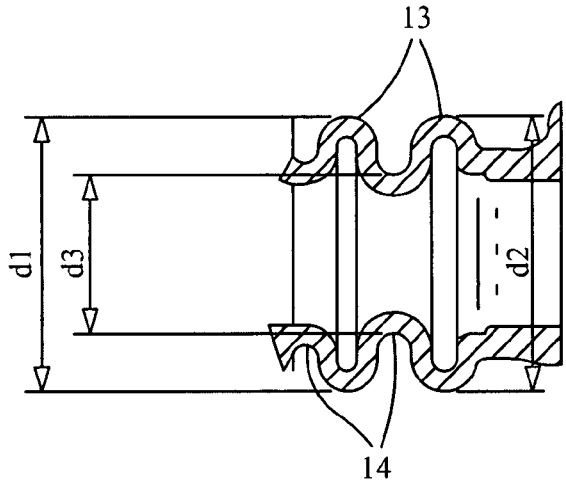
FIG. 3 is a sectional view through the bellows part of the microphone suspension as seen along line 3-3 in FIG. 4.
Figure 4:
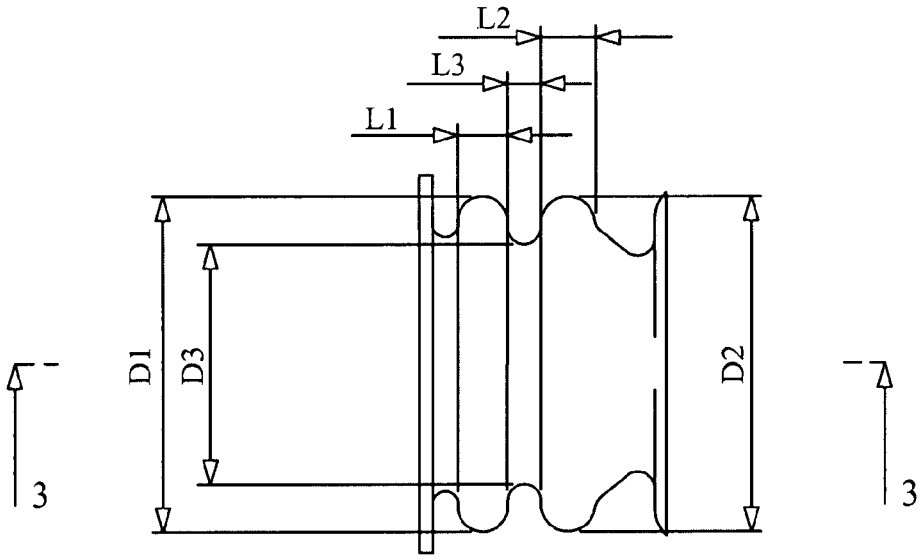
FIG. 4 is a side view of the bellows part of the microphone suspension in FIG. 2.

In FIGS. 3 and 4 the wide parts 13 and narrow parts 14 are shown, whereas the other parts of the suspension are not shown. Due to the oval shape of the bellow, the measure of the wide parts and narrow parts d1, d2 and d3 in FIG. 3 are smaller than the corresponding perpendicular measures D1, D2, and D3 in FIG. 4. In the displayed embodiment the wide parts d1 and d2 are the same and preferably this measure is between 2 and 3 mm and preferably 2.6 mm. The size of d3 is between 1 and 2 mm and is preferably set to 1.5 mm. The size of D1 and D2 is also the same and ranges between 3 and 4 mm and is preferably 3.8 mm. The size of D3 is between 2 and 3 mm and preferably 2.7 mm. The difference between d1 and D1 or d2 and D2 defines the extent of deviation from a round shape and more or less pronounced deviation is possible within the basic idea of the invention.

From FIG. 2 it is clear that the oval shape is nice and rounded, but a more square shape would also work.

From FIG. 4 the length of the two wide parts can be seen and it is clear that the two lengths L1 and L2 are not the same. Hereby it is ensured that consecutive sections comprising wide and narrow parts do not have the same resonance frequencies. In this case L1 is chosen to 0.60 mm and L2 is chosen to 0.69 mm and L3 is chosen to 0.40 mm. For the function of the invention the actual sizes are not crucial, but the difference in size between L1, L2 and L3 is of importance. The L1-L3 measures define the size of the diameter of the circular arch part forming the surface of the respective bellow units in a radial plane. When varying one parameter like the L measure, it is important to not vary other parameters like the material thickness, as such a variation might counteract the variations in the L measure. This could cause similar resonance frequencies of consecutive bellows sections even if the L or diameter measures are varied. In this detailed example the bellows is used as a microphone suspension in a hearing aid, but for other components the sizes would have to be scaled according to the components in question.

The invention claimed is:

1. Suspension tube for a transducer, said suspension tube functioning as a sound-guide for directing sound between the transducer and a cabinet of an audio processing device, wherein the suspension tube has means for forming a connection with an inlet/outlet of the transducer at a first end and means for forming a connection with a wall of the external cabinet of the audio processing device at a second end in order to guide sound through the tube, where an intermediate part of the tube in a length direction has alternating wide and narrow parts, wherein the wide and narrow parts are shaped as circumferentially extending bellows, and wherein a material thickness of the suspension tube does not vary between the connection with the inlet/outlet of the transducer and the connection with the wall of the cabinet.

2. Suspension tube as claimed in claim 1, wherein a circumference thereof is oval shaped.

* * * * *